US009822745B2

(12) United States Patent
Akiyama

(10) Patent No.: US 9,822,745 B2
(45) Date of Patent: Nov. 21, 2017

(54) INJECTOR DRIVE DEVICE

(71) Applicant: Fuji Jukogyo Kabushiki Kaisha, Tokyo (JP)

(72) Inventor: Hiroyuki Akiyama, Tokyo (JP)

(73) Assignee: SUBARU CORPORATION, Tokyo (JP)

( * ) Notice: Subject to any disclaimer, the term of this patent is extended or adjusted under 35 U.S.C. 154(b) by 50 days.

(21) Appl. No.: 14/845,095

(22) Filed: Sep. 3, 2015

(65) Prior Publication Data

US 2016/0069311 A1 Mar. 10, 2016

(30) Foreign Application Priority Data

Sep. 5, 2014 (JP) ..... 2014-181091

(51) Int. Cl.
*F02M 51/06* (2006.01)

(52) U.S. Cl.
CPC ..... *F02M 51/061* (2013.01)

(58) Field of Classification Search
CPC ..... F02M 51/061
See application file for complete search history.

(56) References Cited

U.S. PATENT DOCUMENTS 4,445,491 A * 5/1984 Ishikawa ..... F02P 9/007 123/143 B
6,384,512 B1 * 5/2002 Maeda ..... F02D 41/2096 310/316.03
6,407,593 B1 6/2002 Kawamoto et al.
7,117,852 B2 * 10/2006 Santero ..... F01L 9/02 123/478

(Continued)

FOREIGN PATENT DOCUMENTS

JP 2000-345898 A 12/2000
JP 3573001 B2 10/2004

(Continued)

OTHER PUBLICATIONS

Japanese Office Action in Japanese Application No. 2014-181091 dated Feb. 9, 2016 with an English translation thereof.

(Continued)

*Primary Examiner* — Joseph Dallo
(74) *Attorney, Agent, or Firm* — McGinn IP Law Group, PLLC

(57) ABSTRACT

An injector drive device supplies driving electric power to injectors injecting fuel to cylinders of an internal combustion engine. The cylinders are grouped into multiple groups including at least a first cylinder group and a second cylinder group. The injector drive device includes: a booster circuit that boosts voltage of electric power supplied from an external power source; a first and second capacitors that accumulates electric power to be supplied to the injectors of the first cylinder group and the second cylinder group respectively; switch elements that selectively supply the output of the booster circuit to the capacitors; and a controller that, in the case where a charging amounts of the capacitors both are below a predetermined value, switches the switch elements to supply the output of the booster circuit preferentially to the capacitor that has a shorter period until a next planned fuel discharge start.

1 Claim, 4 Drawing Sheets

(56) References Cited

U.S. PATENT DOCUMENTS 7,193,396 B2 * 3/2007 Orr ..... H02M 3/1582 323/225
7,385,833 B2 * 6/2008 Keung ..... H02M 3/158 323/222
7,812,503 B2 * 10/2010 Kakehi ..... H02M 3/158 310/316.03
7,878,177 B2 * 2/2011 Czekala ..... F02D 35/021 123/406.47
8,065,070 B2 * 11/2011 Czekala ..... F02D 35/021 123/478
8,686,697 B2 * 4/2014 Ujike ..... H02M 3/155 323/222
8,866,454 B2 * 10/2014 Nair ..... H02M 3/1582 323/259
2006/0075994 A1 * 4/2006 Santero ..... F01L 9/02 123/490
2009/0051247 A1 * 2/2009 Kakehi ..... H02N 2/067 310/316.03
2009/0101114 A1 * 4/2009 Czekala ..... F02D 35/021 123/480
2011/0087422 A1 * 4/2011 Czekala ..... F02D 35/021 701/103
2012/0217949 A1 * 8/2012 Ujike ..... H02M 3/155 323/311

FOREIGN PATENT DOCUMENTS

JP 2007-146721 A 6/2007
JP 2012-159025 A 8/2012

OTHER PUBLICATIONS

JPO Decision to Grant dated Aug. 2, 2016, with an English translation.
JPO Notification of Refusal dated Feb. 9, 2016, with an English translation.
Chinese Office Action dated Jan. 5, 2017.

* cited by examiner

INJECTOR DRIVE DEVICE

CROSS-REFERENCE TO RELATED APPLICATIONS

The present application claims priority from Japanese Patent Application No. 2014-181091 filed on Sep. 5, 2014, the entire contents of which are hereby incorporated by reference.

BACKGROUND

1. Technical Field

The present invention relates to injector drive devices that supply valve-opening voltage to injectors of cylinders in a multi-cylinder internal combustion engine, and more particularly relates to an injector drive device with improved freedom in setting injection timing when different cylinders have adjacent injection timings.

2. Related Art

A drive device for a gasoline direct injector that directly injects pressurized gasoline into a combustion chamber (into a cylinder) is provided with a high-voltage power source to boost voltage from a battery, so that an injection valve can be opened in a stable manner even under higher fuel pressure. Such injector drive devices perform control where high voltage is temporarily applied when starting to open the valve, the current is increased to open the valve with an electromagnet, and thereafter the voltage is lowered and the opened valve state is maintained while reducing current, by power supplied from a normal electrical component driving battery (e.g., DC 12 V).

High voltage power sources such as described above generally typically include a booster circuit that is a DC-DC converter, and a capacitor capable of temporarily storing electric power. The booster circuit is relatively expensive and also is large in size, so even in engines where each of multiple cylinders are provided with injectors, high voltage is often supplied to each cylinder from a single set of booster circuit and capacitor. This arrangement is often used for engines around six cylinders or so in scale.

In such arrangements, the high-voltage source is usually designed with an optimized capacity of the booster circuit and capacitor, which repeatedly charges and discharges. The reason is that the high-voltage source is only temporarily used when opening the injector valves, and a design where the booster circuit could continuously apply large current to multiple cylinders at high voltage would result in an extremely expensive and large arrangement. For example, in a multi-cylinder engine with regular interval combustion (regular interval ignition), it is impossible for the injection start periods to overlap if injection is only performed once per cycle. Accordingly, the specifications for the high-voltage power source are decided by obtaining the minimum value for power source capabilities such that the above-described charge/discharge cycle will generally work at maximum revolutions.

However, there recently are cases that injection is divided into several times if the stroke period is long as compared to the fuel injection period, from the perspective of fuel mixture in the cylinder and formation of air-fuel mixture. For example, in the case of performing injection multiple times in an engine having three or more cylinders, so as to straddle the intake stroke and compression stroke, the injection start periods may overlap depending on the injection timing settings. Accordingly, there may be situations where the high-voltage power source substantially needs to be used at the same time. Examples of such a case include where a three-cylinder, 240° craft-shank angle (CA), regular-interval combustion engine has injection intervals of 240° CA for each of the multiple times of injection, and where a four-cylinder, 180° craft-shank angle (CA), regular-interval combustion engine has injection intervals of 180° CA for each of the multiple times of injection.

Such cases of using the high-voltage power source at multiple cylinders at the same time, or cases of using the high-voltage power source continuously in a short period of time, cause fluctuation in the current flowing to the injector and the applied voltage. The fluctuation results in a change in valve-opening properties and variance in fuel injection amount, thereby restricting injection timing settings. However, there are cases where a restricted timing is the optimal value for optimizing engine performance relating to fuel consumption, exhaust gasses, and so forth. This means that the engine performance cannot be optimized due to injector driving restrictions in such cases.

As examples of related art attempting to deal with this problem, Japanese Patent No. 3573001 describes grouping injectors with no overlapping operations, and providing capacitor to each group for storing electric power. Japanese Unexamined Patent Application Publication (JP-A) No. 2000-34589 describes disposing a switch element upstream of the capacitors, to select capacitors that have not discharged, so as to make a chargeable circuit configuration.

However, the art described in Japanese Patent No. 3573001 involves having to stop boosting while discharging, since using the booster circuit during discharging the capacitor may cause fluctuation in power source voltage. This is no problem regarding overlapping of single cylinders, but causes charging cycle interference among groups when performing charging operations multiple times in a short period of time.

On the other hand, selectively charging capacitors as in the art described in JP-A No. 2000-34589 enables the amount of time that the booster circuit can be used to be increased, allowing the restriction of charge/discharge cycle interference among groups to be eased to a certain degree, but not sufficiently.

SUMMARY OF THE INVENTION

The present invention has been made in light of the above-described problem, and accordingly it is an object thereof to provide an injector drive device with improved freedom in setting injection timing when different cylinders have adjacent injection timings.

An aspect of the present invention provides an injector drive device that supplies driving electric power to injectors each injecting fuel to the cylinders of an internal combustion engine that has multiple cylinders. The cylinders are grouped into multiple groups including at least a first cylinder group and a second cylinder group. The injector drive device includes: a booster circuit that boosts voltage of electric power supplied from an external power source; a first capacitor that accumulates electric power to be supplied to the injectors of the first cylinder group; a second capacitor that accumulates electric power to be supplied to the injectors of the second cylinder group;

at least one switch element that selectively supplies the output of the booster circuit to the first capacitor and the second capacitor; and a controller that, in the case where a charging amount of the first capacitor and a charging amount of the second capacitor both are below a predetermined value, switches the at least one switch element to supply the output of the booster circuit with priority to the capacitor that has a shorter period until a next planned fuel discharge start.

DETAILED DESCRIPTION

The present invention has solved the problem of providing an injector drive device with improved freedom in setting injection timing when different cylinders have adjacent injection timings. This has been realized by providing a capacitor that supplies high voltage to each of cylinder groups, grouped so that two cylinders 360° apart in ignition order have been paired, at the time of opening the injector valve. In the case where both capacitors are in a state needing charging, the capacitor of which the period till the next planned start of fuel injection is shorter is preferentially charged.

Figure 1:
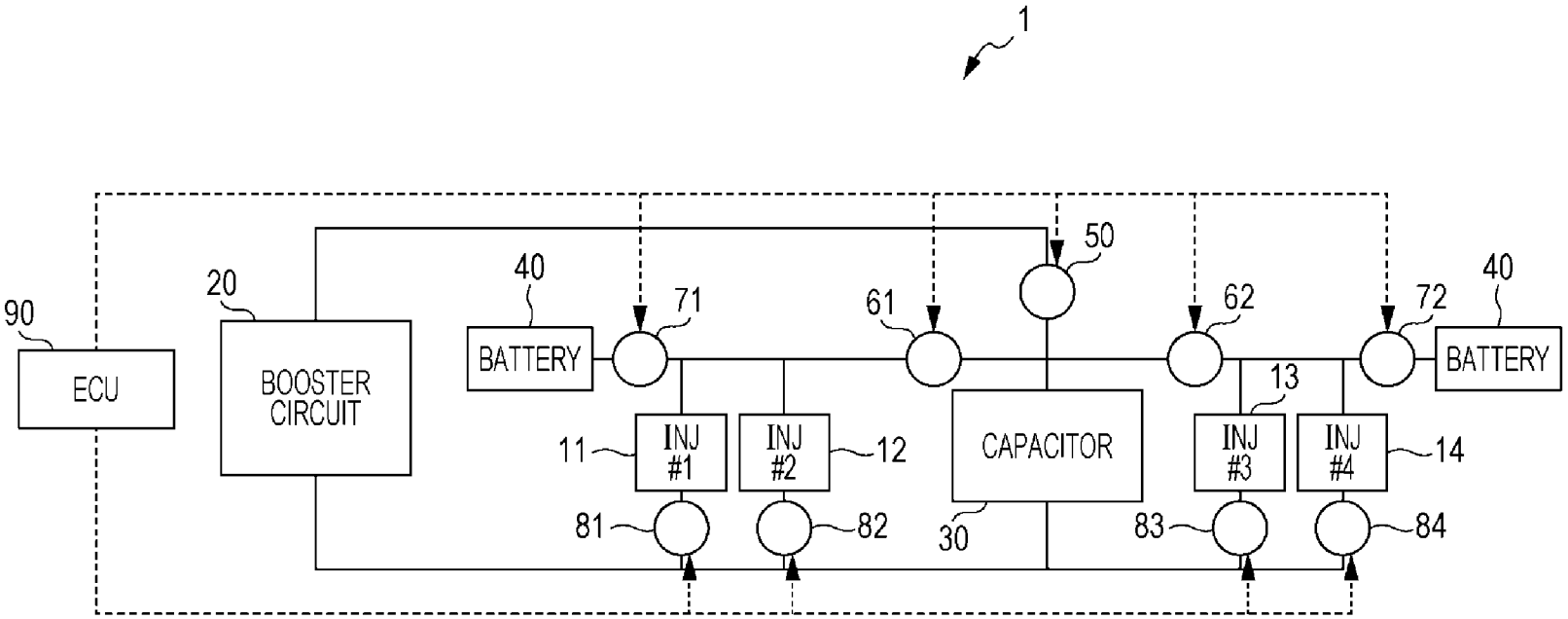
FIG. 1 is a diagram illustrating the configuration of an injector drive device according to a reference example of the present invention.

Before describing an implementation of the injector drive device applying the present invention, an injector drive device according to a reference example of the present invention will be described. FIG. 1 is a diagram illustrating the configuration of the injector drive device according to the reference example.

The injector drive device according to the reference example drives injectors in a four-cylinder direct injection gasoline engine mounted as a driving power source in an automobile such as a passenger car or the like, for example. This engine has regular interval combustion of 180° CA, and the ignition order is in the order of, for example, cylinder No. 1, cylinder No. 3, cylinder No. 2, and cylinder No. 4.

The injector drive device 1 supplies electric power to electromagnets of a No. 1 cylinder injector 11, a No. 2 cylinder injector 12, a No. 3 cylinder injector 13, and a No. 4 cylinder injector 14, to which fuel compressed by a unillustrated fuel pump and accumulated at an accumulator container is supplied. Supply of the electric power drives a needle valve at a predetermined valve opening timing, whereby fuel is injected into the cylinder. The injector drive device 1 is configured also including a booster circuit 20, a capacitor 30, a battery 40, a boost power supply element 50, high-voltage supply elements 61 and 62, low-voltage supply elements 71 and 72, injector conducting elements 81 through 84, an engine control unit 90, and so forth.

The No. 1 cylinder injector 11, No. 2 cylinder injector 12, No. 3 cylinder injector 13, and No. 4 cylinder injector 14 directly inject fuel into the combustion chamber (with the cylinder) of a No. 1 cylinder, No. 2 cylinder, No. 3 cylinder, and No. 4 cylinder, respectively, of a unillustrated engine. The injectors 11 through 14 are supplied with high-voltage power boosted by the booster circuit 20 at the time of valve opening, and stored in the capacitor 30. Once a valve is open, the opened state of the value is maintained by low-voltage power (e.g., 12 V) supplied from the normal electrical component driving battery 40, and thereafter the valve closes when electric conduction stops.

The injectors 11 through 14 are grouped into two groups (cylinder groups), grouped so that two cylinders 360° CA apart in combustion timing (ignition timing) have been paired. In this implementation, the No. 1 cylinder injector 11 and No. 2 cylinder injector 12 are injectors of a first cylinder group, and No. 3 cylinder injector 13 and No. 4 cylinder injector 14 are injectors of a second cylinder group.

The booster circuit 20 is a DC-DC converter that boosts and outputs relatively low-voltage power supplied from the battery or alternator. The capacitor 30 is an accumulator that accumulates high-voltage electric power output from the booster circuit 20. The battery 40 is a secondary battery that supplied electric power to the various electrical components of the vehicle. While FIG. 1 illustrates the battery 40 in two locations to facilitate illustration, these are in fact a single battery (the same in the later-described FIG. 3). The battery 40 is a lead-acid battery having a rated output of DC 12 V, and is charged by electric power generated by the alternator, for example.

The boost power supply element 50, high-voltage supply elements 61 and 62, low-voltage supply elements 71 and 72, and injector conducting elements 81 through 84 are each switch elements having field-effect transistors (FET) or the like, capable of turning conduction of power on and off in accordance with signals from the engine control unit 90. The boost power supply element 50 turns supply of electric power from the booster circuit 20 to the capacitor 30 on and off. The boost power supply element 50 is turned off in the case where charging of the capacitor 30 is unnecessary (the amount of accumulated power is a predetermined level or higher), and when the capacitor 30 is discharging. Otherwise, the capacitor 30 is on and the capacitor 30 is charged. Note that commonly-used flyback booster circuits often do not have the boost power supply element 50.

The high-voltage supply element 61 supplies the high-voltage power output from the capacitor 30 to the No. 1 cylinder injector 11 and No. 2 cylinder injector 12 that are the injectors of the first cylinder group. The high-voltage supply element 62 supplies the high-voltage power output from the capacitor 30 to the No. 3 cylinder injector 13 and No. 4 cylinder injector 14 that are the injectors of the second cylinder group.

The low-voltage supply element 71 supplies the low-voltage power output from the battery 40 to the No. 1 cylinder injector 11 and No. 2 cylinder injector 12 that are the injectors of the first cylinder group. The low-voltage supply element 72 supplies the low-voltage power output from the battery 40 to the No. 3 cylinder injector 13 and No. 4 cylinder injector 14 that are the injectors of the second cylinder group. The injector conducting elements 81 through 84 are each switch elements provided to the ground side of the respective No. 1 cylinder injector 11 through No. 4 cylinder injector 14, for individually switching on/off of conductance of power to the injectors 11 through 14.

The engine control unit (ECU) 90 centrally controls the engine and to her accessories. The CPU 90 is configured including, for example, an information processor such as a central processing unit (CPU) or the like, storage such as random access memory (RAM) and read-only memory (ROM), an input/output interface, a bus connecting these components, and so forth. The ECU 90 functions to individually switch the switch elements such as the boost power supply element 50, high-voltage supply elements 61 and 62, low-voltage supply elements 71 and 72, injector conducting elements 81 through 84, and so forth, on and off according to predetermined fuel injection timings.

For example, in the case of the No. 1 cylinder injector 11 of the first cylinder group performing injection, at the time of opening the valve the high-voltage supply element 61 is tuned on, the low-voltage supply element 71 off, and the injector conducting element 81 on, and high-voltage power is supplied from the capacitor 30. Thereafter, after the valve opening operation is completed, the high-voltage supply element 61 is turned off, the low-voltage supply element 71 on, and the injector conducting element 81 on, so as to switch to low-voltage power from the battery 40, and the opened state is maintained. After a predetermined valve opening period elapses, the injector conducting element 81 is turned off, conductance of electricity to the No. 1 cylinder injector 11 is stopped, and the valve closes.

Figure 2:
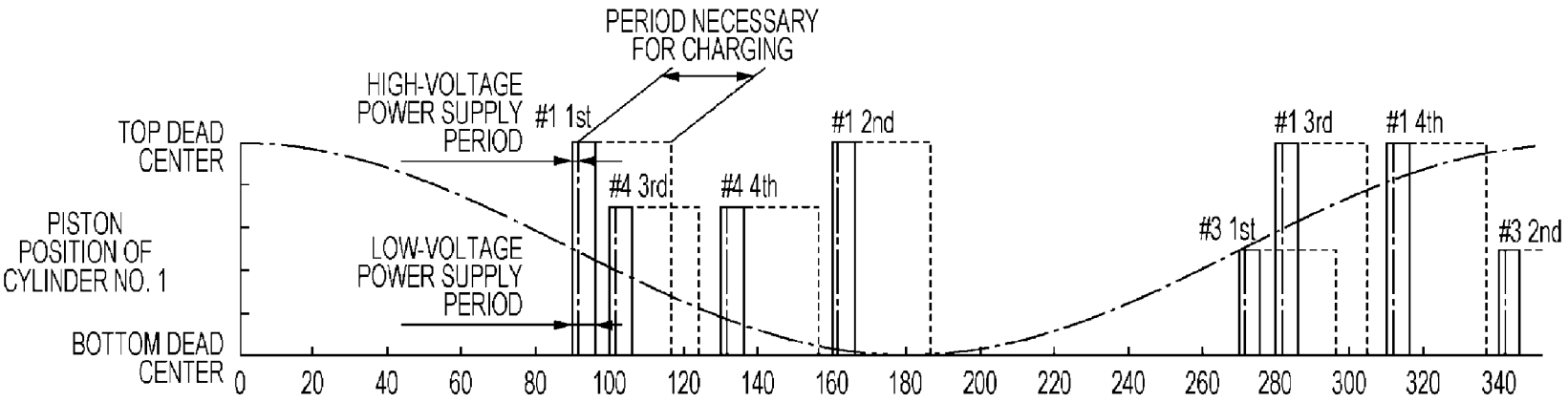
FIG. 2 is a timing chart illustrating an example of injection timings of cylinders in a four-cylinder engine.

Next, injection timing control in a four-cylinder direct injection gasoline engine will be described. FIG. 2 is a timing chart illustrating an example of injection timing of each cylinder in the four-cylinder engine. The number of injections per cycle is four times, for example, in the example illustrated in FIG. 2, and the division ratio is 0.25 (each time equidistant). The injection pulse duration each time is 600 μs, for example.

The injection start timings for the first injection, second injection, third injection, and fourth injection, respectively are 90°, 160°, 280°, and 310°, as crank angle from the top dead center at the point of starting suction. The first through fourth injections of the first cylinder are each indicated by the symbols "#1 1st" through "#1 4th" in FIG. 2. In the same way, the third and fourth injections of the fourth cylinder are indicated by "#4 3rd" and "#4 4th", and the first and second injections of the third cylinder are indicated by "#3 1st" and "#3 2nd". The solid lines represent the injection timing (valve opening timing) in each injection period, and the dotted line following this indicates the period necessary for charging the capacitor 30 after injection. In each injection period, the period from the start of injection to the single-dot dashed line represents the high-voltage power supply period (valve opening period), while the subsequent period represents the low-voltage power supply period (valve-open maintaining period). The period necessary for charging the capacitor 30 is indicated by the dotted line from after the single-dot dashed line high-voltage power supply period.

FIG. 2 illustrates that immediately after the first injection of the No. 1 cylinder, the third injection and fourth injection of the No. 4 cylinder are sequentially performed, and subsequently the second injection of the No. 1 cylinder is performed. Also, immediately prior to the third injection of the No. 1 cylinder, the first injection of the No. 3 cylinder is performed, and immediately after the fourth injection of the No. 1 cylinder, the second injection of the No. 3 cylinder is performed. In the case of sequentially performing injection at short time intervals by the injectors of the first cylinder group and second cylinder group in this way, in the injector drive device according to the reference example, the capacitor 30 may not be sufficiently charged, and this may result in unstable operations due to fluctuation in voltage and current when opening valves.

Next, an implementation of an injector drive device applying the present invention will be described. Parts that are substantially in common with the above-described reference example will be denoted by the same reference numerals and omitted from description. The following description will dwell mainly on the points that are different.

Figure 3:
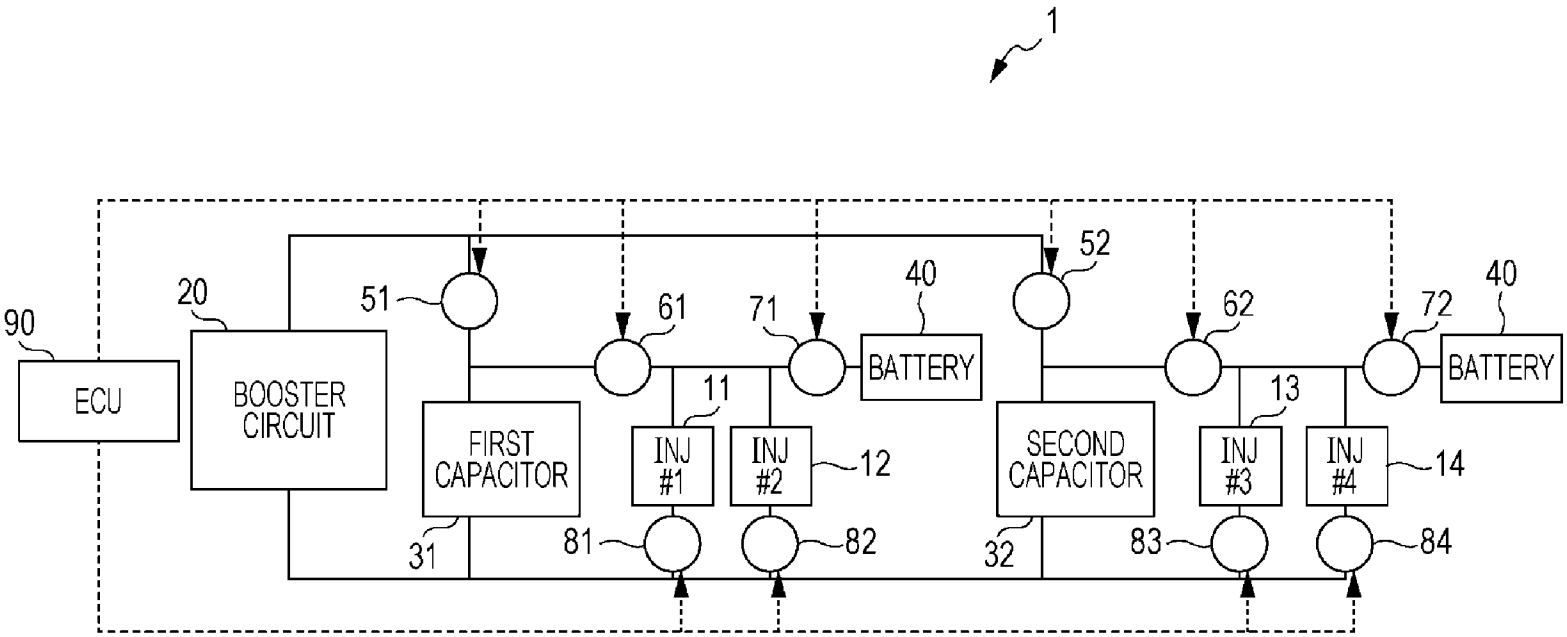
FIG. 3 is a diagram illustrating the configuration of an injector drive device according to an implementation applying the present invention.

FIG. 3 is a diagram illustrating the configuration of the injector drive device according to the implementation. The injector drive device 1 according to the implementation has a first capacitor 31 and a second capacitor 32 instead of the capacitor 30 in the reference example. Also, boost power supply elements 51 and 52 that individually supply power to the capacitors 31 and 32 are provided instead of the boost power supply element 50 in the reference implementation.

The first capacitor 31 supplies high-voltage power to the No. 1 cylinder injector 11 and No. 2 cylinder injector 12 when opening valves. The second capacitor 32 supplies high-voltage power to the No. 3 cylinder injector 13 and No. 4 cylinder injector 14 when opening values.

The boost power supply element 51 turns supply of electric power from the booster circuit 20 to the first capacitor 31 on and off. The boost power supply element 52 turns supply of electric power from the booster circuit 20 to the second capacitor 32 on and off.

Further, the high-voltage supply element 61 in the implementation supplies power output from the first capacitor 31 to the No. 1 cylinder injector 11 and No. 2 cylinder injector 12 that are the injectors of the first cylinder group, and the high-voltage supply element 62 supplies power output from the second capacitor 32 to the No. 3 cylinder injector 13 and No. 4 cylinder injector 14 that are the injectors of the second cylinder group.

The ECU 90 in the implementation switches the boost power supply elements 51 and 52 on and off in an alternating and synchronized manner, so that one or the other of the first capacitor 31 and second capacitor 32 can be selectively charged. This charging control will be described below in detail.

Figure 4:
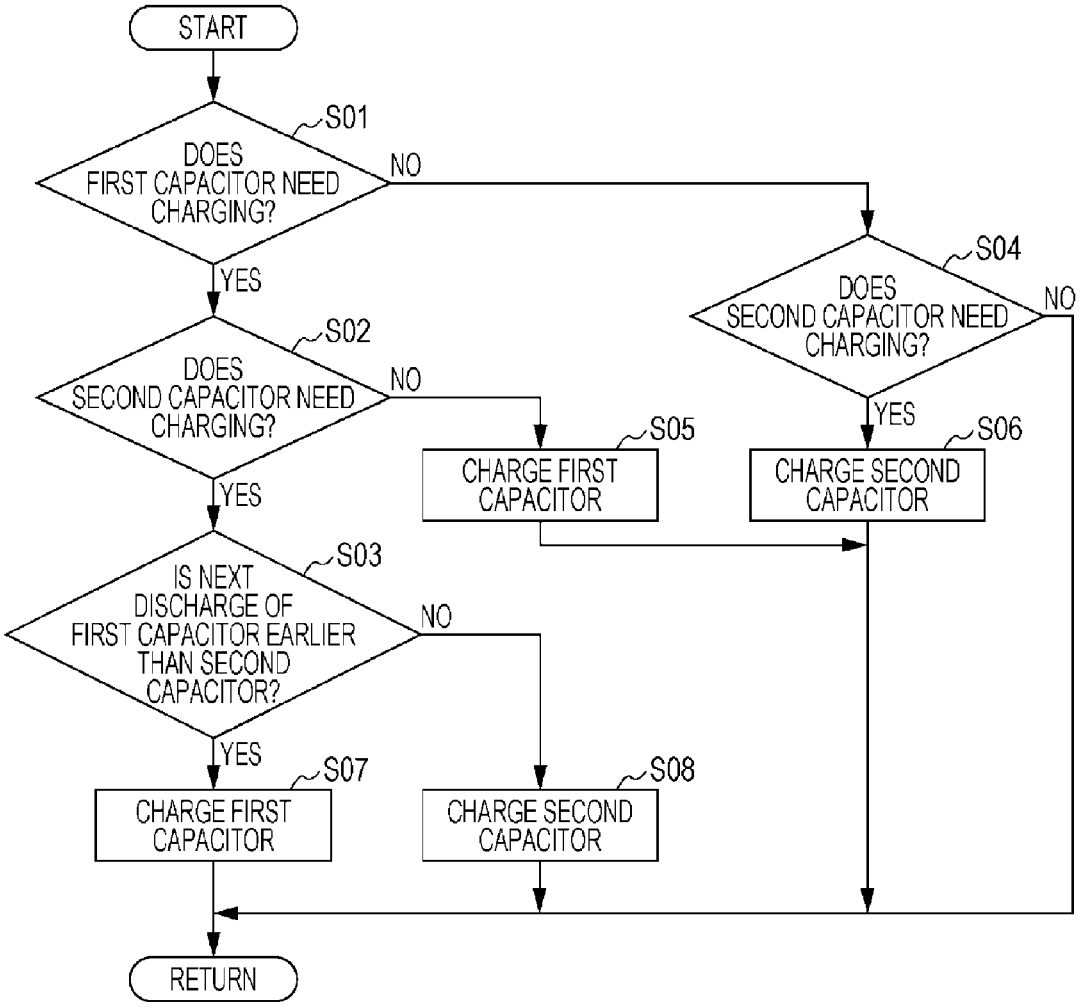
FIG. 4 is a flowchart illustrating charging control of capacitors in the injector drive device according to the implementation.

FIG. 4 is a flowchart illustrating charging control of capacitors in the injector drive device according to the implementation. Each step will be described in order.

Step S01: First Capacitor Charging Necessity Determination

The ECU 90 detects the amount of electric power accumulated in the first capacitor 31, and in the case where this is below a predetermined value, determines that charging is necessary, and the flow advances to step S02. On the other hand, in the case where the power is equal to or more than the predetermined value, the ECU 90 determines that charging is unnecessary, and the flow advances to step S04.

Step S02: Second Capacitor Charging Necessity Determination

The ECU 90 detects the amount of electric power accumulated in the second capacitor 32, and in the case where this is below a predetermined value, determines that charging is necessary, and the flow advances to step S03. On the other hand, in the case where the amount of power is equal to or more than the predetermined value, the ECU 90 determines that charging is unnecessary, and the flow advances to step S05.

Step S03: Next Discharge Timing Determination

The ECU 90 references a fuel injection timing control map or the like that it holds, and determines whether or not the injection start timing of the earlier next-injection-timing of the No. 1 cylinder injector 11 and No. 2 cylinder injector 12, which are injectors of the first cylinder group, comes before the injection start timing of the earlier next-injection-timing of the No. 3 cylinder injector 13 and No. 4 cylinder injector 14, which are injectors of the second cylinder group. If the next-injection-timing of an injector in the first cylinder group comes before the next-injection-timing of an injector in the second cylinder group, the flow advances to step S07, and otherwise advances to step S08.

Step S04: Second Capacitor Charging Necessity Determination

The ECU 90 detects the amount of electric power accumulated in the second capacitor 32, and in the case where this is below a predetermined value, determines that charging is necessary, and the flow advances to step S06. On the other hand, in the case where the amount of power is equal to or more than the predetermined value, the ECU 90 determines that charging is unnecessary, and the flow ends (returns). At this time, both boost power supply elements 51 and 52 are turned off, and neither the first capacitor 31 nor second capacitor 32 is charged.

Step S05: Charging First Capacitor

The ECU 90 turns the boost power supply element 51 on and the boost power supply element 52 off, and charges the first capacitor 31. Thereafter the flow ends.

Step S06: Charging Second Capacitor

The ECU 90 turns the boost power supply element 51 off and the boost power supply element 52 on, and charges the second capacitor 32. Thereafter the flow ends.

Step S07: Charging First Capacitor

The ECU 90 turns the boost power supply element 51 on and the boost power supply element 52 off, and charges the first capacitor 31. Thereafter the flow ends.

Step S08: Charging Second Capacitor

The ECU 90 turns the boost power supply element 51 off and the boost power supply element 52 on, and charges the second capacitor 32. Thereafter the flow ends.

According to the implementation described above, the one of the first capacitor 31 and second capacitor 32 of which the time till the next discharge is shorter is preferentially charged, and after this charging the other capacitor is charged. Thus, the effects of interference in charge/discharge cycles among the cylinder groups can be reduced. Also, the first and second capacitors 31 and 32 can be charge and discharged independently, so injectors 11 through 14 of different cylinder can be opened at the same time, and one capacitor can be charged while discharging the other.

Accordingly, an injector drive device with stable valve operations when different cylinders have adjacent injection timings can be provided, and the freedom in setting fuel injection timing can be improved, thereby enabling engine performance relating to exhaust and fuel consumption to be optimized. The configuration according to the implementation can be realized simply by adding one capacitor and one switch element to the reference implementation, so there are few additional electric elements to be added, thereby suppressing increase in costs. Modifications The present invention is not restricted to the above-described implementation; rather, various modifications and alterations may be made, which also are within the technical scope of the present invention.

(1) The implementation has been described with reference to an example of a four-cylinder engine, but the present invention can be applied to other engines of other displacements, such as a six-cylinder engine, for example. Grouping of the injectors is not restricted to two groups as in the implementation, and three or more groups may be used. For example, in the case where the engine is a V8 engine, the cylinders of each bank may be grouped into two groups, and control the same as the implementation described above be performed at each bank.

(2) The circuit configuration such as the layout of capacitors and switching elements, and so forth, is not restricted to the configuration in the implementation, and can be changed as suitable.

(3) The implementation has been described with reference to an example of a direct-injection gasoline engine, but the present invention is not restricted to this, and is applicable to other fuel-using engines as well.

The invention claimed is:

1. An injector drive device that supplies driving electric power to injectors each injecting fuel to the cylinders of an internal combustion engine that has multiple cylinders, wherein the multiple cylinders are grouped into multiple groups including at least a first cylinder group and a second cylinder group, the injector drive device comprising:

a booster circuit that boosts voltage of electric power supplied from an external power source;

a first capacitor that accumulates electric power to be supplied to the injectors of the first cylinder group;

a second capacitor that accumulates electric power to be supplied to the injectors of the second cylinder group;

at least one switch element that selectively supplies the output of the booster circuit to the first capacitor and the second capacitor based on a measurement of a charging amount of the first capacitor and a charging amount of the second capacitor; and a controller that, in the case where the charging amount of the first capacitor and the charging amount of the second capacitor both are below a predetermined value, switches the at least one switch element to supply the output of the booster circuit selectively to the capacitor that has a shorter period until a next planned fuel discharge start out of the first capacitor and the second capacitor, wherein the charging and discharging of the first capacitor and the second capacitor is carried out independently.

* * * * *